United States Patent [19]

Mackal

[11] 4,223,805

[45] Sep. 23, 1980

[54] AUTOMATIC INFLATOR

[76] Inventor: Glenn H. Mackal, Buena Vista Dr., Ringwood, N.J. 07456

[21] Appl. No.: 931,271

[22] Filed: Aug. 4, 1978

[51] Int. Cl.[3] ..... B63C 9/24

[52] U.S. Cl. ..... 222/5; 9/316

[58] Field of Search ..... 222/5, 54; 9/9, 314, 9/316, 317, 318, 319, 320, 323, 324; 141/38, 329

[56] References Cited

U.S. PATENT DOCUMENTS

| | | | |
|---|---|---|---|
| 2,480,033 | 8/1949 | Kramer | 222/5 X |
| 2,778,434 | 1/1957 | Hastert et al. | 222/5 X |
| 3,266,669 | 8/1966 | Vuyosevich | 9/316 X |
| 3,597,780 | 8/1971 | Coyle | 222/5 X |
| 3,809,288 | 4/1974 | Mackal | 222/5 |
| 3,997,079 | 12/1976 | Nieman | 222/5 |

*Primary Examiner*—Sherman D. Basinger

[57] ABSTRACT

There is disclosed an inflator for the inflation of inflatable articles such as life vests and the like, such inflator being operated automatically upon being subjected to water as upon the ditching or parachuting of an aviator wearing a life vest provided with such inflator. In the preferred embodiment of the inflator disclosed, the automatically operating portion of it is embodied as an attachment to a known manually operated inflator, the resulting inflator being capable of operation both manually and automatically. The automatically operating portion of the inflator incorporates a latch which holds a plunger operated by a coil compression spring in cocked condition until the latch releases the plunger, which thereafter thrusts a piercing pin against and through the sealing diaphragm of a gas-containing capsule. The latch is provided with a water-destructible member which retains the latch in plunger cocking position until the water-destructible member is subjected to water in an amount sufficient to weaken it so that the latch releases the plunger.

14 Claims, 11 Drawing Figures

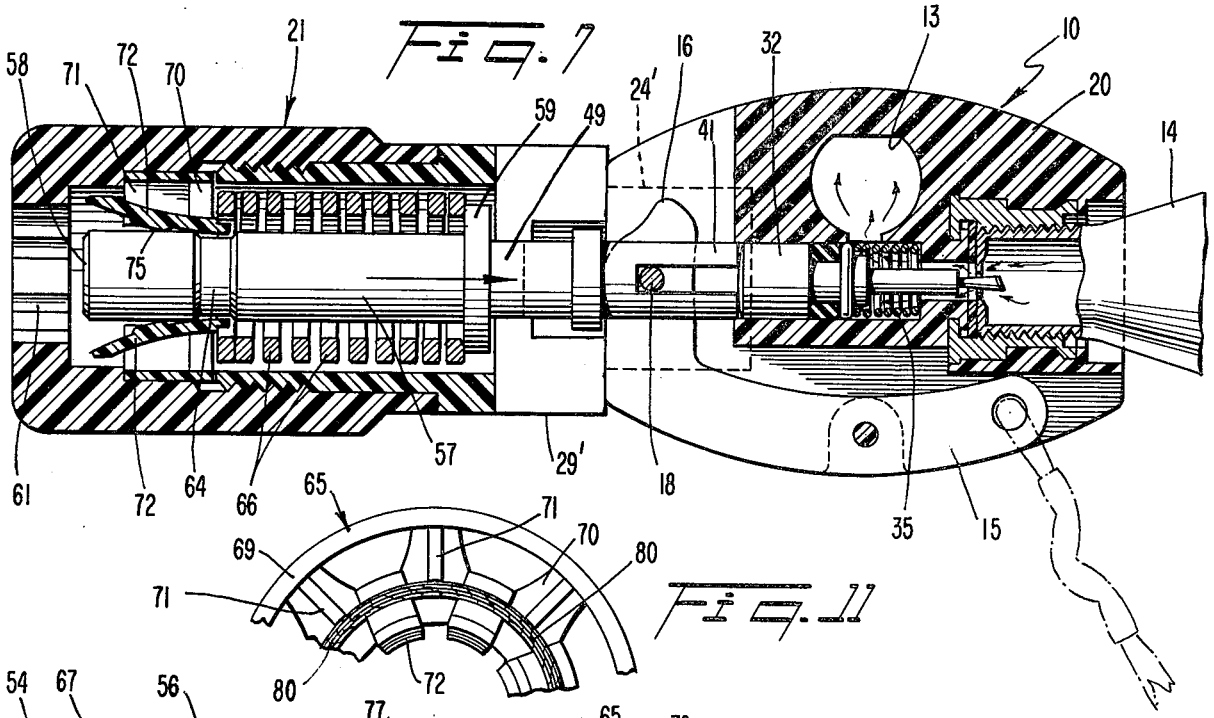
Fig. 11
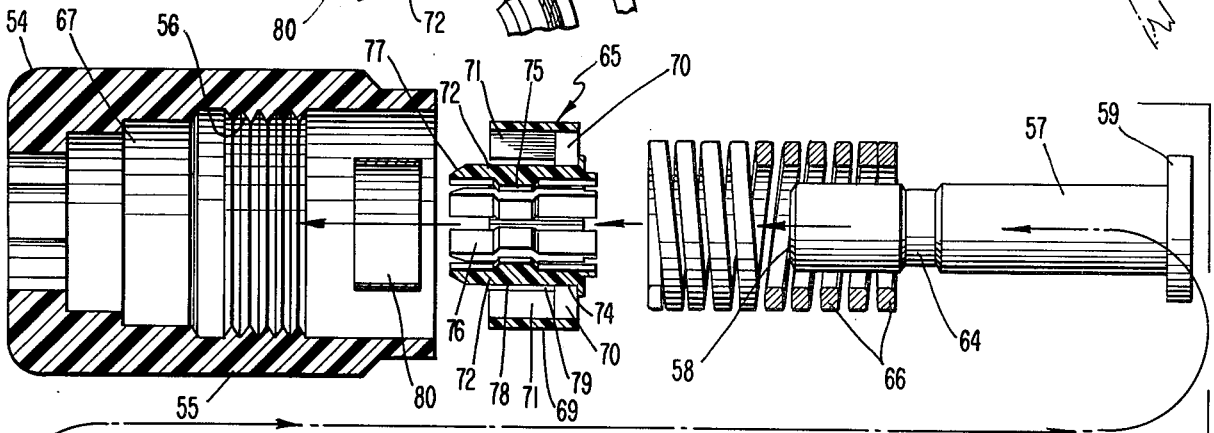
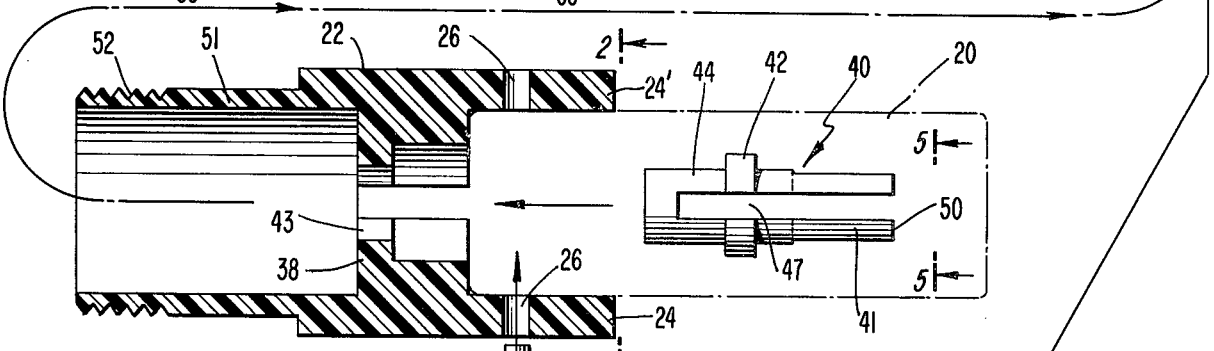
Fig. 8
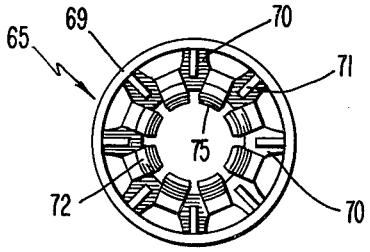
Fig. 9
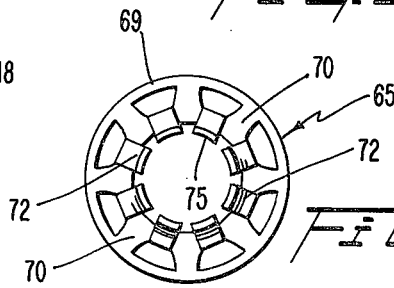
Fig. 10

AUTOMATIC INFLATOR

This application is related to the pending application of Glenn H. Mackal, Ser. No. 930,035 filed Aug. 1, 1978, the disclosure of which is incorporated by reference herein in its entirety, and to the pending application of Glenn H. Mackal, Ser. No. 931,432 filed Aug. 7, 1978.

This application relates to an automatic inflator for inflatable articles such as life vests and the like. In the disclosed preferred embodiment thereof, the inflator is capable of operation both manually and automatically, the automatically operating portion of the apparatus being preferably embodied as an attachment to a previously known manually operated inflator, the resulting, combined device retaining its ability to be operated manually while adding the capability of being operated automatically upon its subjection to water as being submerged therein when employed with a life vest worn by a ditching or parachuting aviator.

Automatic inflators have been previously proposed. Among such prior disclosed automatic inflators are the following: Muller, U.S. Pat. Nos. 1,329,990; Spidy, 2,894,658; Waters, 3,242,514; Fujimoto, 3,494,506; and Niemann, 3,997,079. Of these, only Fujimoto and Niemann disclose automatic inflators which are also capable of operation manually. In Fujimoto a lever-operated cam, an automatic, water-responsive mechanism, and a gas capsule which is moved toward a stationary piercing pin are arranged in that order. The operation of the inflator manually by the lever-operated cam may well cause operation of the automatic inflator portion of the device, a result which is neither necessary not desirable. In Niemann, although the automatically operating portion of the device is disposed in series in that order with the manually operating portion thereof and the piercing pin, a part of the automatically operating mechanism is disposed in a first, removable part of the housing and another part of the automatically operating mechanism is disposed in a second part of the housing, and remains therein when the first part of the housing is removed and the inflator is operated only manually. Further, the removal of the first housing part leaves the second housing part in open condition, vulnerable to its being fouled both by physical and atmospheric agencies.

It is among the objects of the present invention to overcome the outlined disadvantages of the prior art and to provide an automatically operated mechanism, responsive to being immersed in water, to effect the piercing of a gas containing capsule, which in a preferred embodiment thereof, may be easily attached to and held securely as a part of a complete manually operable inflator which by itself is complete and presents a substantially closed outline. The automatic inflator of the invention may be either supplied to the trade as a separate item, which can be easily attached to existing manually operated inflators, or the combined automatic mechanism and the manually operated inflator may be assembled and sold as a unit.

The invention will be more readily understood upon consideration of the accompanying drawings, in which:

FIG. 7 is a view similar to FIG. 6 but with the parts shown in the positions which they occupy after the device has been fired or discharged in order to pierce the sealing means of the gas capsule mounted thereon;

FIG. 8 is an exploded view of the automatic inflation mechanism;

FIG. 9 is a view in end elevation of the means in the automatic inflation mechanism which latches the mechanism in its cocked condition, the view being taken in the direction from left to right in FIG. 8;

FIG. 10 is a view in end elevation of the latching means of FIG. 9, the view being taken in the direction from right to left in FIG. 8; and FIG. 11 is a fragmentary view on an enlarged scale showing a part of the latching means of FIG. 9 with a moisture responsive element mounted therein whereby the latching means is held in its operative, latching condition.

Figures 1, 2, 3, 4, 5, 6:
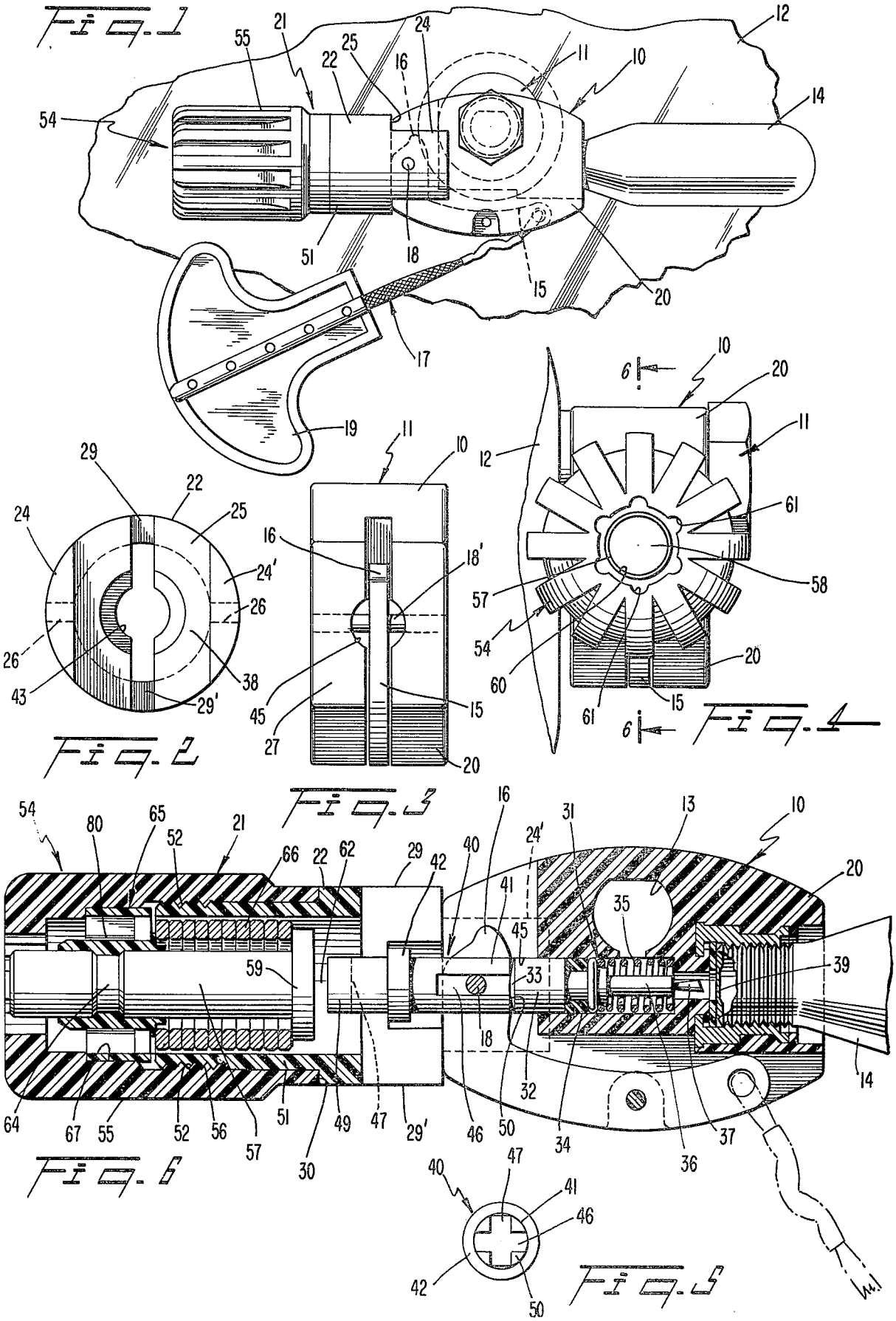
FIG. 1 is a view in elevation of a preferred embodiment of the automatic inflator of the invention, such inflator being shown attached by a fitting to a portion of the wall of an inflatable article, the inflator shown including a prior, manually operable inflator to which there has been added a mechanism for rendering the inflator automatically operable upon being immersed in water.
FIG. 2 is a view in end elevation of the body of the automatic mechanism added to the manual inflator, the view being taken along the line 2—2 in FIG. 8 in the direction of the arrow.
FIG. 3 is a view in end elevation of the manually operated inflator taken in the direction from left to right in FIG. 1, and depicting the end of the manual inflator upon which the end of the automatic mechanism shown in FIGS. 2 and 4 is mounted.
FIG. 4 is a view in end elevation of the device shown in FIG. 1, the view being taken in the direction from left to right in that figure.
FIG. 5 is a view in end elevation of a double-slotted intermediate pin which coacts with the piercing pin of the manual inflator and which constitutes a part of the automatic inflation mechanism of the invention.
FIG. 6 is a view in vertical axial section through the device shown in FIGS. 1 and 4, the section being taken along the line 6—6 in FIG. 4, the automatic inflation mechanism being shown in its unfired, or cocked condition.

Turning now to FIG. 1, there is there shown a manually operated inflator 10 which is that shown in Mackal U.S. Pat. No. 3,809,288, May 7, 1974. Inflator 10 is attached by a fitting generally designated 11 to an inflatable article, a part of the wall of which is shown at 12. A capsule 14 containing gas such as $CO_2$ under pressure is screwed onto the body 20 of the inflator 10 and sealed thereto. When a sealing means which spans the neck of the capsule 14 is pierced, gas is released from the capsule and flows into a chamber therein from which it is discharged through the fitting 11, which is mounted and sealed in an opening 13 in the body 20. The piercing of the capsule 14 by the manually operated inflator 10 is effected by the turning of a lever 15 by a lanyard 17 about a pivot which is mounted on the body 20, thereby to cause a cam 16 integral with the lever to advance a piercing pin against and through the seal of the capsule. The lanyard 17 is provided with a handle 19 by which the lanyard may be pulled.

The automatic inflator mechanism, which is added to inflator 10, is generally designated 21. Member 21 has a circular cylindrical portion 22 from which there project to the right (FIG. 1) two wings 24, 24' which are mirror images of each other and which are spaced apart a distance which only slightly exceeds the thickness of the body 20 of the inflator 10, that is, the horizontal dimension thereof as such body 20 is shown in FIG. 3.

The automatic inflator 21 is secured to the body 20 of the manual inflator 10 by a pin 18 which replaces the original shorter pivot pin 18' (FIG. 3) of the manually operated inflator 10, pin 18 passing through holes 26 in the wings 24, 24' and through the holes in the body 20 which were designed to receive the shorter pivot pin 18'. When thus mounted and held on the body 20, the members 20 and 21 are firmly and securely held together without movement between them since the flat root surface 25 between the wings 24, 24' on the body 22 is firmly in engagement with the flat rear end surface 27 of the body 20 of the manual inflator 10.

The body 22 further has similar diametrically disposed slots 29, 29', whichever one of such slots being disposed lower (FIGS. 1 and 6) when the bodies 20 and 22 are assembled, receiving the lever 15 as it is swung clockwise from its position as there shown into a position somewhat past the vertical when it has advanced the piercing pin to form a hole in the sealing means of the capsule 14. The lower edge 3 of the slot 29' (FIG. 6) forms a stop for the lever 15 in its fully swung-out position.

The piercing pin assembly of the manually operated inflator 10 is substantially the same as that disclosed and claimed in application Ser. No. 916,497, now abandoned filed June 19, 1978 of Glenn H. Mackal. As shown in FIG. 6, the inflator 10 has a piercing pin which is designated generally by the reference character 31, pin 31 having a larger diametered rear end portion 32 with a rounded rear end surface 33 which coacts with the surface of the cam 16. An O-ring 34 disposed in the groove in portion 32 of the pin seals the pin to the longitudinal bore in which it reciprocates between the position shown in FIG. 6 and that shown in FIG. 7. A coil compression spring 35, acting between a shoulder at the forward end of portion 32 of the piercing pin and an annular shoulder in the passage through the body 20 constantly urges the piercing pin toward the position thereof shown in FIG. 6. Telescoped within the spring 35 is a smaller diametered portion 36 of the piercing pin, forwardly of which there is disposed the outer, active piercing portion 37 of the piercing pin. Portion 37 of the pin confronts and is spaced from (FIG. 6) the central portion 39 of a sealing diaphragm spanning the neck of the capsule 14. When the piercing pin is moved to the right as shown in FIG. 7, whether by manual operation of the inflator 10, or by automatic operation by the mechanism 21, the portion 37 of the piercing pin pierces a hole in the sealing means 39 and remains protruding through such hole as shown in FIG. 7 whether it has been moved to such position by the lever 15 or by the automatic inflation mechanism 21. Because the lever is stopped in its clockwise movement by the bottom edge of the slot 29' when the manual inflator 10 is operated, the cam 16 may remain of the configuration shown in Mackal U.S. Pat. No. 3,809,288, rather than being of circular configuration beyond the high point of the cam, as in the above referred to Mackal patent application Ser. No. 916,497, filed June 19, 1978.

The automatic inflation mechanism 21 includes a cross-slotted intermediate pin 40 having a forward circular cylindrical portion 41, a flange 42 rearwardly of portion 41, and a rear end portion 49. Portion 41 of pin 40 is of such diameter as to be guidingly received within the bore 45 (FIGS. 3 and 6) of the body 20. In order that the pin 40 can extend inwardly within bore 45 far enough so that its forward end 50 engages the rear end 33 of the piercing pin, and also so that the pin 40 can reciprocate with respect to both the pivot pin 18 and the cam carrying end of the lever 15 the pin 40 is cross-slotted as shown, a first, axially shorter slot 46 being located in the forward portion 41 of pin 40 and terminating at its rear end somewhat short of the flange 41, slot 46 receiving the pivot pin 18. The second slot 47, which is disposed at right angles to the slot 46, extends lengthwise of the pin 40 from its forward end through the flange 41 to a point near its rear end leaving, however, an unslotted portion 49 at its rear end. The slot 47 receives the rear end of the lever 15 and the cam 16 carried thereby. As noted, the intermediate pin 40 is guided at its forward end by the bore 45 in the body 20. The rear end portion 44 of pin 40 is received within a central bore 43 in a flange 38 in the body 22 of the automatic inflator 21. The flange 42 on the pin 40, by its engagement with the flange 38, prevents the pin 40 from travelling rearwardly past the position thereof shown in FIG. 6.

Rearwardly of the portion 22 of the body of the automatic inflator 21 is provided with a thin-walled skirt 51 provided with external screw threads 52. Coacting with skirt 51 is a cap 54 having an elongated skirt 55 bearing internal screw threads 56 which cooperate with threads 52. As shown in FIGS. 1 and 4, the cap 54 is externally longitudinally and radially fluted, to aid in gripping the cap when screwing it home on the skirt 51.

Disposed within the housing formed by the parts 51 and 54 is a longitudinally centrally extending plunger having a central stem 57 and a disc-like head 59 secured to the forward end of the stem. In the cocked position of the plunger 57, 59 shown in FIG. 6, the outer end of the stem extends into a guiding loosely fitting opening 60 in the end of the cap 54, there being further semi-circular openings in the surface of the hole 60, so that access is provided through the openings 60 and 61 to the interior of the housing 51, 54. The outer end surface 58 of the stem 57 may be distinctively colored so that it may readily be determined when the automatic inflator is cocked (FIG. 6), in which condition surface 58 lies near or flush with the outer end surface of the cap 54, and the fired or discharged condition of the automatic inflator (FIG. 7) in which the outer end surface 58 of the stem 57 of the plunger lies markedly inwardly of the openings 60 and 61 in the end of the cap 54. It is to be noted that when the plunger 57, 59 is in the cocked position of FIG. 6, a substantial space 62 exists between the forward end of the head 59 of the plunger and the rear end surface of part 49 of the intermediate pin. This permits the plunger, under the impetus of spring mechanism now to be described, to gain substantial speed in a forward direction, after it has become uncocked, before the head 59 of the plunger impacts upon the rear end portion of the intermediate pin 40.

In its cocked position shown in FIG. 6, the plunger 57, 59 is constantly urged in a direction from left to right by a compressed coil compression spring 66. A latching mechanism 65 coacting with an annular groove 64 in the stem 57 of the plunger retains the plunger in its cocked position. The latching mechanism 65, which is shown more specifically in FIGS. 8–11, inclusive, is mounted in an annular seat 67 in the cap 54, mechanism 65 being telescoped over the stem 57 of the plunger as shown in FIG. 6.

The disclosed inflator employs a latching mechanism 65 which is substantially the same as that designated 61 in Mackal application Ser. No. 930,035, filed Aug. 1, 1978. Turning now to FIGS, 8, 9, 10, and 11, the latching mechanism 65, which in a preferred embodiment it is made of plastic material such as "Delrin" (an acrylic resin sold by DuPont) has an axially short sleeve 69 from the rear (FIG. 10) end of which there project inwardly a plurality of equally angularly spaced axially short radial posts 70 integral with sleeve 69. Extending forwardly from each post 70 is a circumferentially thin radial blade 71, blade 71 extending forwardly to terminate with the forward edge of the sleeve 69. A plurality of separate axially extending segments which are spaced circumferentially from each other but which approximate an axially split inner sleeve coaxial of sleeve 69 are integrally connected at their rear ends and lie between successive posts 70. The points of attachment of the rear ends of the segments 72 to the posts 70 are designated 74. Each segment 72 has a radially inwardly extending lug or tooth 75 integral therewith, the teeth 75 being spaced a substantial distance axially forwardly of the points of attachment 74. The annular groove 64 in the stem 57 of the plunger has diverging beveled end walls, the lugs or teeth 75 having a configuration generally conforming to that of the section of the groove 64 so that they fit therewithin when the plunger is cocked, as shown in FIG. 6.

The forward ends of the segments 72 extend substantially axially forwardly of the forward edges of the sleeve 69 and the blades 71 as shown in FIG. 8. The forward ends 76 of the segments have their forward radially outer edges beveled at 77 as shown, the outer edges 78 of the segments, rearwardly of the beveled portion 77, being straight and lying along the surface of a circular cylinder in the position of the segments shown in FIGS. 6 and 8–11, inclusive. There is thus presented an annular space 79 between the edges 78 of the segments 72 and the radially inner edges of the blades or fingers 71.

Into such annular space 79 there is thrust a thin sleeve-like coil 80 of water-soluble paper which when dry and backed-up by blades 71 between the radially outer edges 78 of the segments 72, has sufficient strength to retain the segments in the position shown in FIG. 6 against the outwardly directed force exerted upon them by the interaction between the rear beveled wall of the groove 64 on the stem 57 of the plunger and the correspondingly beveled rear edge of each of lugs 75 when the automatic inflator is cocked. It will be seen that the coil of paper 80 is under both tension and compression, the tension arising by reason of its engagement with the edges 78 of the segments 72, and the compression arising by reason of its being jammed between the radially inner edges of the blade 71 and the two immediately adjacent segments 72.

Upon the immersion of the inflator 10, 21 in water, as by reason of the ditching of an aviator provided with a Mae West lifesaving vest, water seeps into the interior of the housing 51, 54 and weakens or dissolves the paper coil 80 to such extent that the compressive force of spring 66 drives the plunger 57, 59 forwardly so that it in turn drives the intermediate pin 40 forwardly and such pin drives the piercing pin 32 into the position of FIG. 7. As the plunger 57, 59 moves forwardly, the lugs 75 move out of the annular groove 64 and distort the inner ring or sleeve formed by the segments 72 as shown in FIG. 7, the outer end of the stem 57 then sliding freely past the narrow pried-apart lugs 75 of the segments 72.

Although the invention as illustrated and described with reference to a single preferred embodiment thereof, it is to be expressly understood that it is in no way limited by the disclosure of such a single embodiment, but is capable of numerous modifications within the scope of the appended claims.

What is claimed is:

1. A gas inflator for an inflatable article, the inflator being selectively operable either manually or automatically upon its subjection to water, comprising an inflator body, means for attaching a gas-containing capsule to said body, a capsule-piercing pin movable in the body toward the capsule, manually operated means acting directly on the outer end of the piercing pin to thrust the inner end of the piercing pin toward the capsule, a second pin aligned with the piercing pin and having an end confronting and adapted selectively to engage said outer end of the piercing pin, and automatically operated means responsive to its subjection to water to thrust the second pin axially against the said end of the piercing pin to thrust the piercing pin toward the capsule, the manually operated means for thrusting the piercing pin toward the capsule comprising a rotable cam directly engaging the said end of the piercing pin, and a pivot pin mounting the cam on the body, the second pin having a first slot in the end thereof which confronts the said end of the piercing pin, the pivot pin passing through said first slot, the first slot permitting the longitudinal movement of the second pin relative to the pivot pin.

2. The inflator according to claim 1, comprising a lever attached to the cam for rotating the cam, and wherein the second pin has a second slot therein in the end thereof confronting the said end of the piercing pin, the second slot being disposed at right angles with respect to the first slot and receiving the cam therewithin.

3. The inflator according to claim 2, wherein the cam and lever are disposed coplanar, and the second slot in the second pin receives both the cam and a portion of the cam operating lever.

4. The inflator according to claim 1, wherein the automatically operated inflating means is contained in a housing secured to the body of the inflator, and the second pin is guided partially in the body of the inflator and partially in the housing.

5. The inflator according to claim 4, wherein the body is generally flat, and the housing containing the automatic inflating mechanism is disposed at one end of the body in general alignment with the plane of the body, and comprising means for attaching the housing to the body, the cam being disposed adjacent one end of the body, the said one end of the body having a third slot to receive the cam and lever, the end of the housing confronting the body having a fourth slot aligned with the third slot, the fourth slot receiving the lever when it is swung in a manual inflating operation to advance the piercing pin in a capsule-piercing stroke.

6. The inflator of claim 5, wherein the piercing pin has a shank of frusto-conical configuration, a cutting edge on the forward, larger-diametered end of the piercing pin, and wherein the piercing pin remains within the capsule at the end of its capsule-piercing stroke, the fourth slot having a bottom end which functions to stop the lever and thus the cam at the end of the forward piercing stroke of the piercing pin in the manual operation of the inflator.

7. The inflator of claim 4, wherein the body of the manual inflator is flat with generally parallel opposite sides, the housing is disposed in alignment with the general plane of the body, and the housing has on the end thereof adjacent the body spaced parallel ears, said ears being disposed on opposite sides of the body of the manual inflator, the pivot pin which mounts the cam passing from ear to ear of the housing, through the body of the inflator, and through the cam.

8. The inflator of claim 1, wherein the automatic means is contained in a housing secured to the body and aligned with the piercing pin and second pin, and comprising a plunger in the housing aligned with the second pin, resilient means constantly urging the plunger toward the end of the second pin which is remote from the said end of the piercing pin which the second pin confronts, and latching means for holding the plunger cocked with the resilient means in energy-storing condition ready to advance the plunger toward the said end of the second pin, said latching means releasing the plunger when subjected to water.

9. The inflator according to claim 8, comprising stop means to prevent the rearward movement of the second pin past a predetermined point, and wherein the confronting ends of the plunger and the second pin are substantially spaced from each other when the plunger is in cocked condition, whereby the plunger gains momentum, when released by the latching means, before impinging upon the second pin.

10. The inflator according to claim 8, wherein the housing comprises a sleeve-like portion and a cap on the end of the sleeve-like portion remote from the inflator body, means to secure the cap to said end of the housing, and wherein the cap has a seat therein for receiving the latching means, the latching means is of annular shape, and the plunger has a central stem passing through the annular latching means and having a transverse surface coacting therewith.

11. The inflator of claim 10, wherein the resilient means is a coil compression spring interposed between an enlarged head at the forward end of the plunger and the latching means.

12. The inflator of claim 11, wherein the housing has openings therethrough to permit the entrance of water to the latching means, and the latching means includes water-sensitive means to release the stem of the plunger when the inflator is immersed in water.

13. The inflator of claim 12, wherein the annular latching means has teeth on its inner surface, said teeth engaging the transverse surface on the stem of the plunger to hold the plunger in cocked condition with the coil compression spring under compression.

14. The inflator of claim 13, wherein the transverse surface on the stem of the plunger is a steep end wall of an annular groove in the stem intermediate the length thereof.

* * * * *